US005151553A

United States Patent [19]

Suzuki et al.

[11] Patent Number: 5,151,553

[45] Date of Patent: Sep. 29, 1992

[54] MUSICAL TONE CONTROL APPARATUS EMPLOYING PALMAR MEMBER

[75] Inventors: Hideo Suzuki; Shunichi Matsushima; Takamichi Masubuchi; Masahiko Obata; Masao Sakama, all of Hamamatsu, Japan

[73] Assignee: Yamaha Corporation, Hamamatsu, Japan

[21] Appl. No.: 437,850

[22] Filed: Nov. 15, 1989

[30] Foreign Application Priority Data

| | | | |
|---|---|---|---|
| Nov. 16, 1988 | [JP] | Japan | 63-149521[U] |
| Nov. 16, 1988 | [JP] | Japan | 63-289868 |
| Nov. 16, 1988 | [JP] | Japan | 63-289869 |
| Nov. 16, 1988 | [JP] | Japan | 63-289870 |

[51] Int. Cl.[5] ..... G10H 7/00; G10H 1/18

[52] U.S. Cl. ..... 84/600; 84/615; 84/644; 84/670; 84/653; 84/DIG. 7; 341/20

[58] Field of Search ..... 84/600, 644, 647, 670, 84/671, 718, 723, 735, 626, 662, 701, 743, DIG. 7, DIG. 8; 446/26, 615, 622, 653, 659; 341/20

[56] References Cited

U.S. PATENT DOCUMENTS

| | | | |
|---|---|---|---|
| 3,700,836 | 10/1972 | Rackson | 200/52 R |
| 3,704,339 | 11/1972 | Niinomi . | |
| 4,414,537 | 11/1983 | Grimes | 340/365 R |
| 4,635,516 | 1/1987 | Giannini | 84/1.01 |
| 4.768.413 | 9/1988 | Fujimori | 84/609 |
| 4,860,364 | 8/1989 | Giannini | 84/DIG. 8 X |
| 4,905,560 | 3/1990 | Suzuki et al. . | |
| 4,920,848 | 5/1990 | Suzuki | 84/600 |
| 5,005,460 | 4/1991 | Suzuki et al. | 84/600 |

OTHER PUBLICATIONS

Published European Application No. 264,782 to Hiyoshi, et al.

*Primary Examiner*—William M. Shoop, Jr.
*Assistant Examiner*—Jeffrey W. Donels
*Attorney, Agent, or Firm*—Graham & James

[57] ABSTRACT

A musical-tone-control apparatus having digit members worn along the fingers and contracting and expanding in the longitudinal directions of the digit members in response to the bending and straightening of the fingers. The bending of the digit members is detected by detectors coupled to the digit members and the generation of musical tones is controlled on the basis of the detected signal, i.e. the bending of the fingers. The contraction and expansion of the digit members facilitates the bending and straightening of the fingers. The digit members can also rotate in a plane of the hand to further facilitate the movement of the fingers. The digit members are made to bend about the axes positioned on the third joint of the fingers or the second joint of the thumb (the joint just below the root of the fingers or the thumb), which makes the bending of the digit much easier. A palmar member that supports the digit members are curved to conform the shape of the palm, which makes the bending of the fingers easier as well as preventing the displacement of the palm member.

16 Claims, 5 Drawing Sheets

MUSICAL TONE CONTROL APPARATUS EMPLOYING PALMAR MEMBER

BACKGROUND OF THE INVENTION

1. Field of the Invention

The present invention relates to a musical-tone-control apparatus for controlling musical tones according to the movement of the fingers.

2. Prior Art

The generation of sounds in conventional musical instruments, such as a piano, an electronic organ, a guitar, a flute, or the like, are controlled by operating a keyboard, plucking strings, or blowing a pipe.

These conventional musical instruments, however, may restrict the location of performance and/or the posture of the performer. For example, pianos and electronic organs are too large to be carried, so it is impossible for a performer to move his body with the instrument freely during a performance. Guitars and wind instruments can be carried and so do not restrict the location of performance, but they can limit the posture of a performer because these instruments must be hand-held. Thus, unencumbered movement by a performer during performance cannot be expected using conventional instruments.

A "tone generating glove and associated switches" (U.S. Pat. No. 4,635,516) including switches and a tone generating has been proposed. In the glove of the '516 patent, the switches are connected to the tone generating circuit, and both the switches and the tone generating circuit are mounted in the glove. The tone generating circuit produces a tone or tones in response to the actuation of one or more of the switches. Preferably, a switch is positioned at each finger joint of the glove, and the tone generating circuit produces a different tone in response to the actuation of each different switch. In other words, each of the switches uniquely corresponds to each of the tones. Thus, the musical tones are controlled by the bending of fingers.

The conventional apparatus worn on the hand makes it possible for a performer to enjoy the generation of musical tones in response to hand movement because the musical tones are controlled merely by bending the fingers, which does not hinder other motions of the body.

However, the conventional apparatus presents the following problems:

(1) The conventional apparatus cannot accurately respond to the bending of fingers. This is because each switch and other components are not interconnected and are individually attached to the glove, so that the bending of one finger causes sagging on a part of the glove, which hinders the maintenance of contact of the other switches corresponding to the other digits.

(2) In the conventional apparatus, a performer cannot achieve expressive musical performance which the performer wishes. This is because the apparatus can only generate musical tones in response to ON/OFF signals of the switches, and cannot control tone volumes, tone colors, sound effects, etc. in response to the signals of the switches.

SUMMARY OF TH INVENTION

It is therefore an object of the present invention to provide an musical-tone-control apparatus which makes it possible for a performer to enjoy the accurate generation of musical tones in response to the bending of the digits without hindrance of the free motion of the digits.

It is another object of the invention to provide an musical-tone-control apparatus that enables the free and smooth movement of the fingers as well as the hand.

It is a further object of the invention to provide an musical-tone-control apparatus that enables the expressive performance which a performer wishes.

It is still another object of the invention to provide a musical-tone-control apparatus that can control musical tones accurately according to the intention of the performer.

It is still a further object of the invention to provide an musical-tone-control apparatus that can prevent the displacement of the palmar member, which may occur with the motion of the fingers and the hand.

In a first aspect of the present invention, there is provided a musical-tone-control apparatus comprising:

a palmar member worn on the palm of a performer;

digit members each of which is rotatably connected to the upper edge of the palmar member, and worn along the finger of the performer; and detecting means each of which detects the rotation of the digit members and produces musical-tone-control signal according to the detection result, wherein each of the digit members is separated into two segments which are interconnected so as to contract or expand in the longitudinal direction of the digit member in response to the bending or straightening of the finger.

In a second aspect of the present invention, there is provided a musical-tone-control apparatus comprising:

a palmar member worn on the palm of a performer;

rotary members each of which is rotatably connected to the upper edge of the palmar member, the each rotary member is provided so as to rotate in a plane perpendicular to the plane of the hand;

digit members each of which is rotatably connected to the upper portion of the rotary member, and worn along the finger of the performer, each the digit member is provided so as to rotate in the plane of the hand; and detecting means each of which detects the rotation of the rotary members and produces musical-tone-control signal according to the detection result.

In a third aspect of the present invention, there is provided a musical-tone-control apparatus comprising:

a palmar member worn on the palm of a performer;

digit members each of which is rotatably connected to the upper edge of the palmar member, and worn along the finger of the performer;

rotary members each of which rotatably connects the each digit member to the palmar member; and detecting means each of which detects the rotation of the digit members and produces musical-tone-control signal according to the detection result, wherein each of the rotary members is provided on the joint at the root of each finger.

In a fourth aspect of the present invention, there is provided a musical-tone-control apparatus comprising:

a palmar member worn on the palm of a performer;

digit members each of which is rotatably connected to the upper edge of the palmar member, and worn along the finger of the performer, the digit members rotating according to the bending of the fingers; and detecting means each of which detects the rotation of the digit members and produces musical-tone-control signal according to the detection result, wherein palmar member is curved so as to conform to the shape of the palm.

Figure 1:
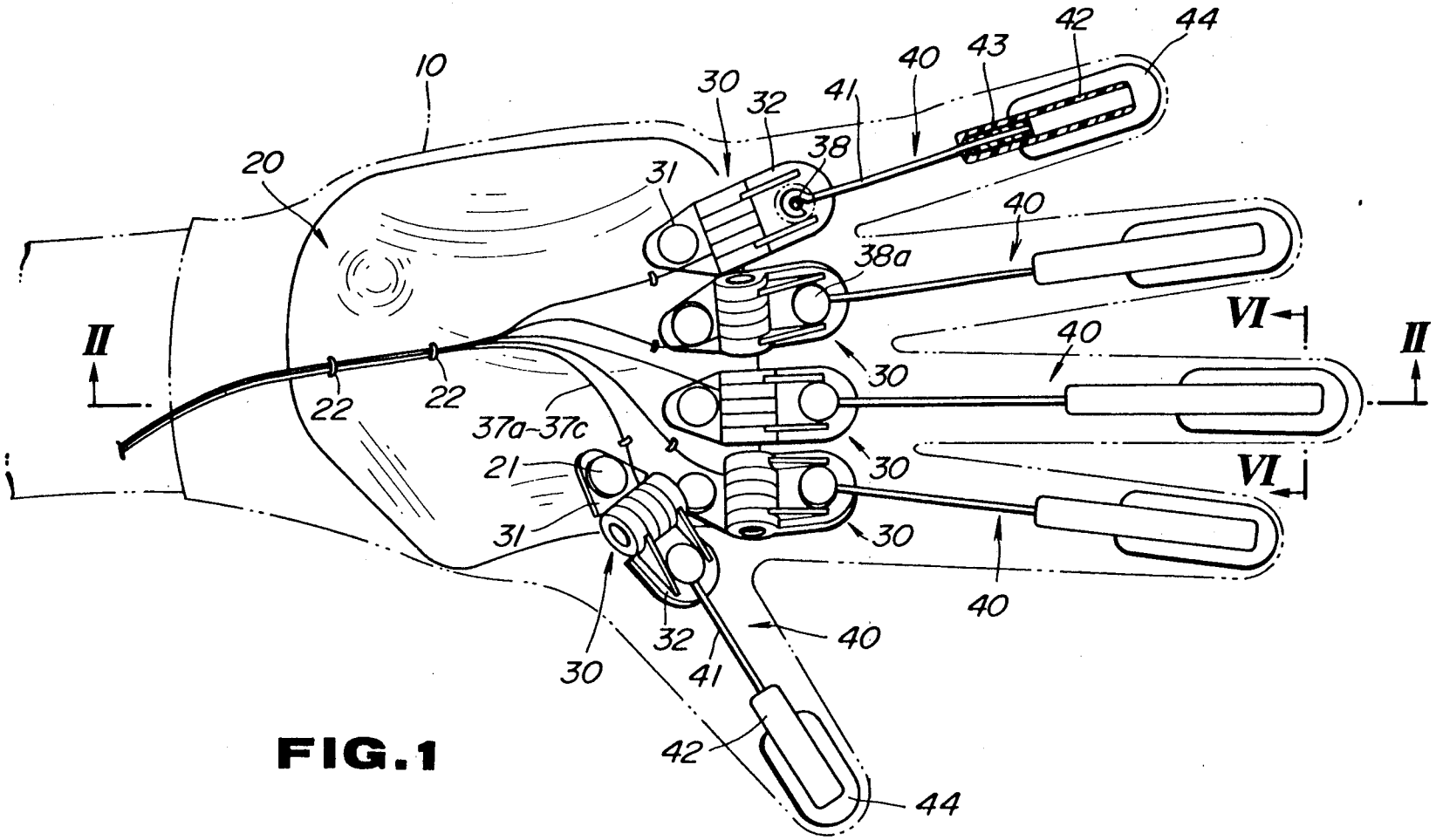
FIG. 1 is a partially cutaway plan view of a musical-tone-control apparatus according to an embodiment of the present invention.
Figure 7:
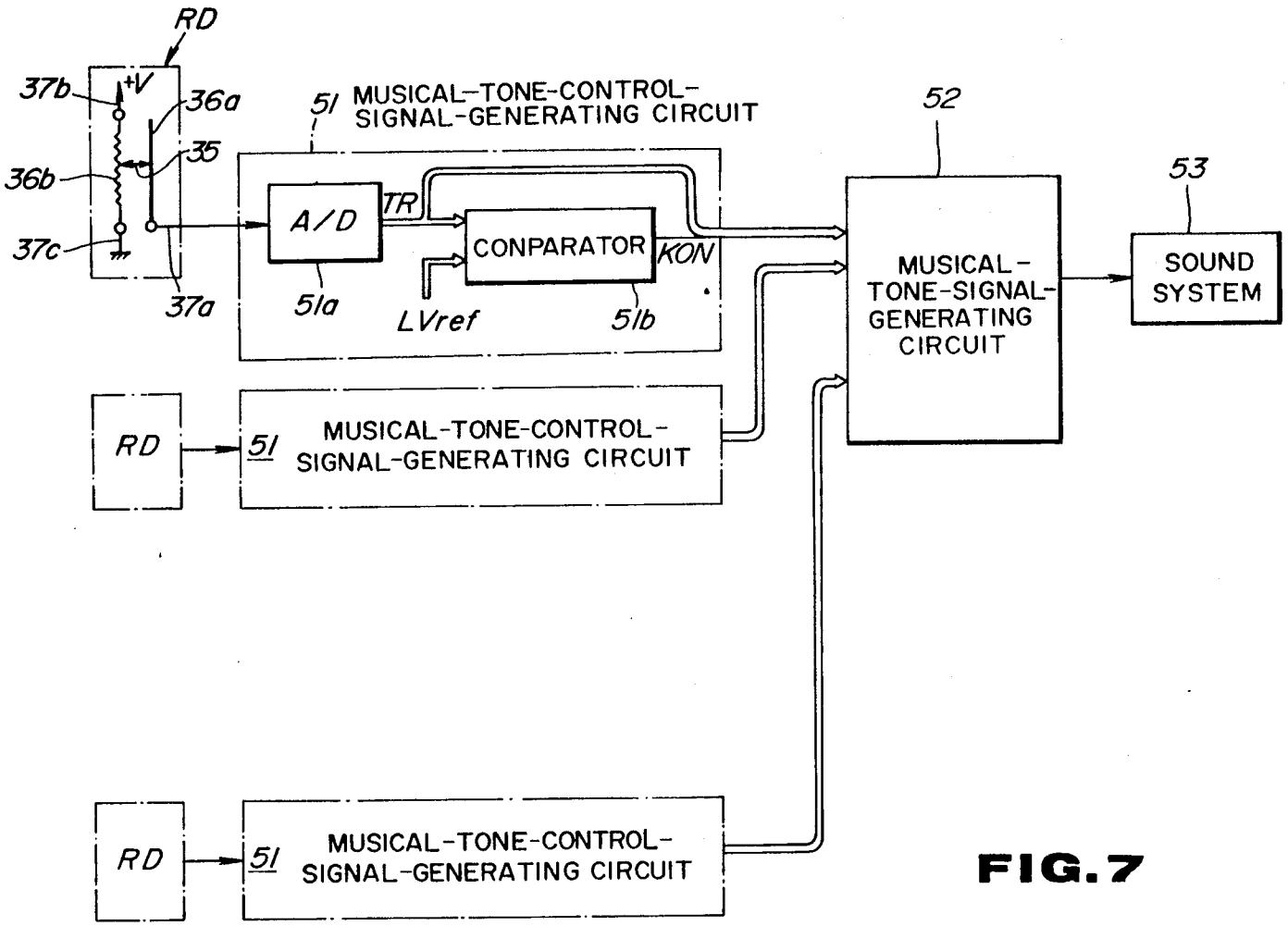
Figure 8:
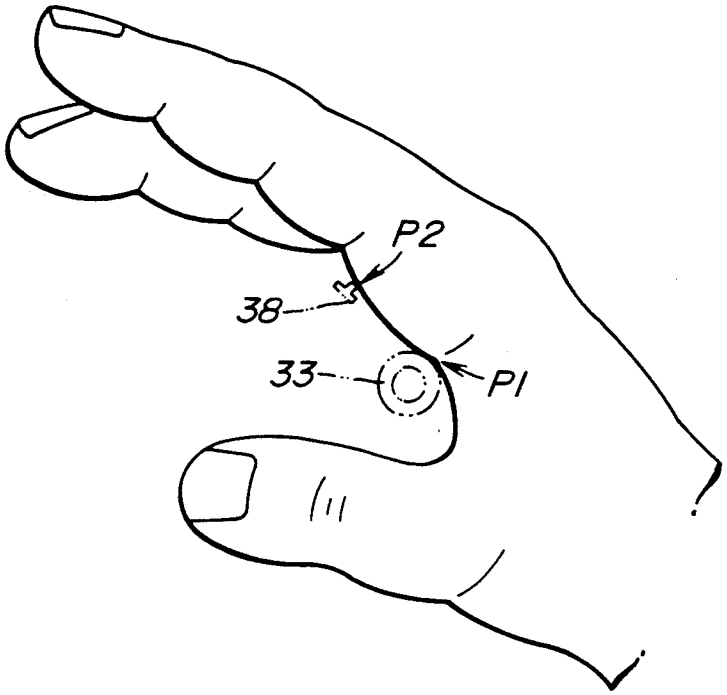
Figure 9:
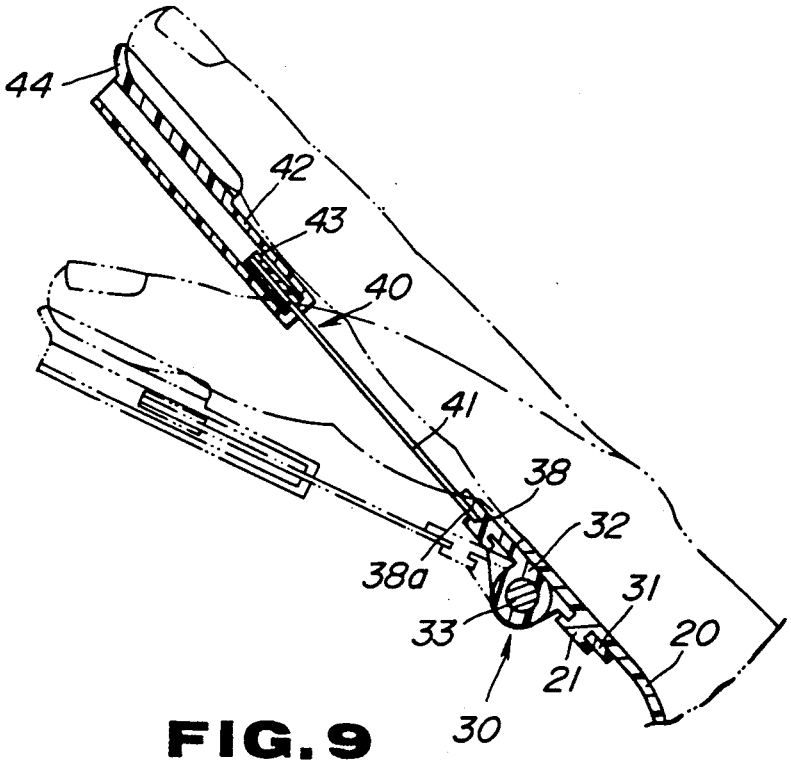

6 is an enlarged sectional view taken on line VI—VI in FIG. 1;

FIG. 7 is a block diagram of a musical-tone-generating apparatus controlled by the musical-tone-control apparatus;

FIG. 8 is a side view showing the position of the musical-tone-control apparatus being worn; and FIG. 9 is an operational view depicting the operation of the musical-tone-control apparatus.

DESCRIPTION OF THE PREFERRED EMBODIMENT

The invention will now be described with reference to the accompanying drawings.

Figure 2:
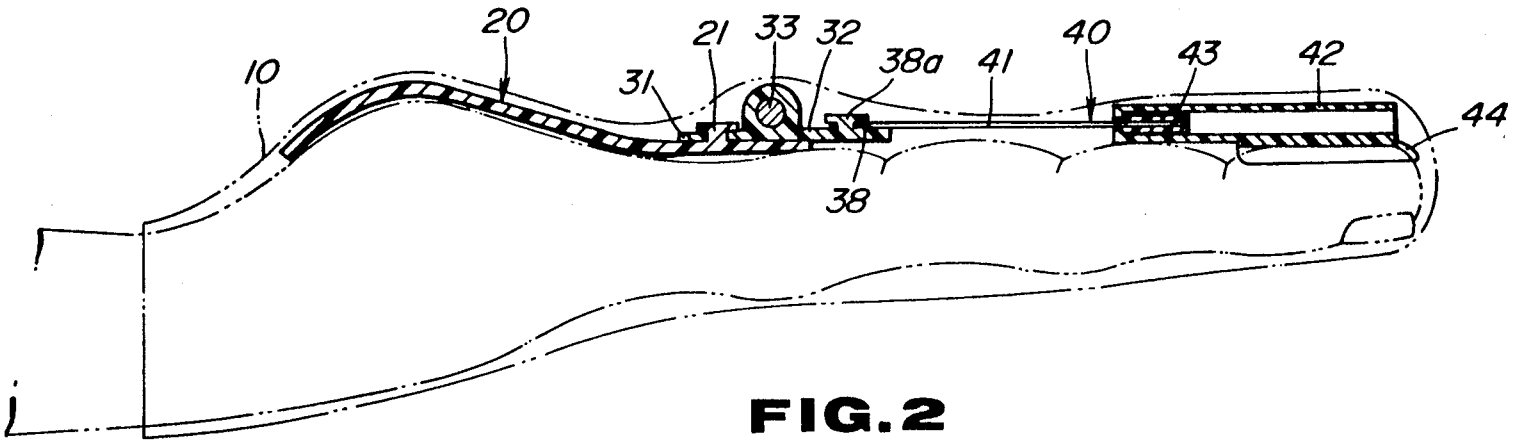
FIG. 2 is a vertical sectional view taken on line II-II in FIG. 1.
Figure 6:
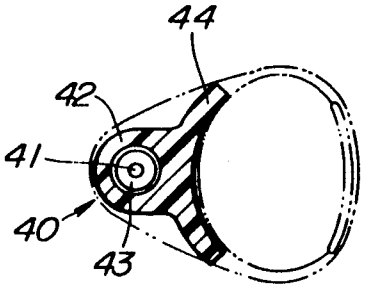

FIGS. 1 and 2 show a musical-tone-control apparatus according to an embodiment of the present invention.

Figure 3:
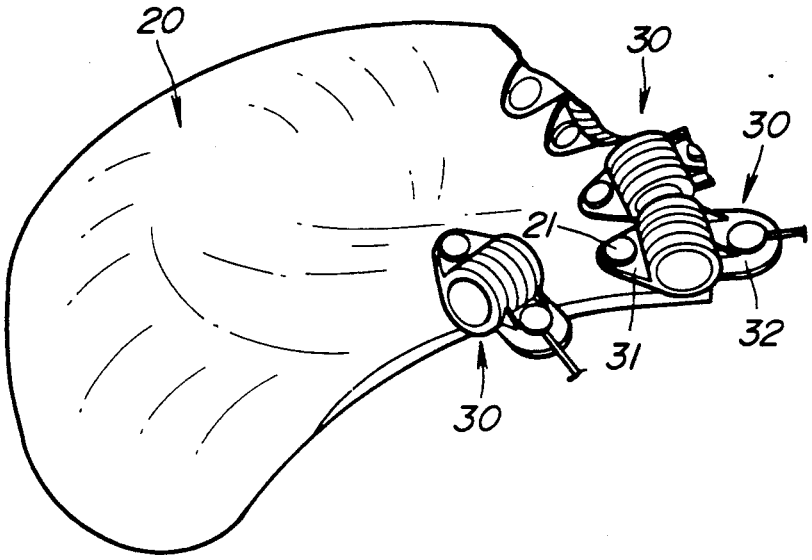
FIG. 3 is a perspective view of a palmar member of the embodiment.

The musical-tone-control apparatus is contained inside the double layer formed on the palm of glove 10, and is provided with palmar member 20 worn on the palm. Palmar member 20, as shown in FIG. 1 to FIG. 3, is made of a piece of thin resin material which conforms to the shape of the palm, so that it conforms to the palm when glove 10 is worn.

Figure 4:
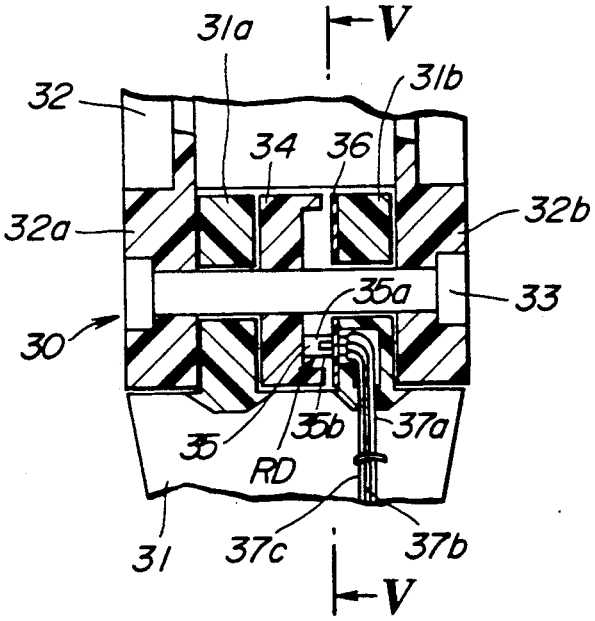
FIG. 4 is an enlarged partially sectional view of a joint portion of the embodiment.

Along the upper margin of palmar member 20, five joint portions 30, 30, . . . corresponding to four fingers and the thumb are provided. To each joint portion 30, each bottom end of five elongated digit members 40, 40, . . . is connected. Each of these digit members 40 is positioned on the inside of each finger and rotates to and fro in response to bending of the finger. Each joint portion 30 consists of fixed member 31 attached to palmar member 20 and rotary member 32 joined to digit member 40, so that the joint portion 30 supports digit member 40 and allows its rotation. Fixed member 31 is fastened at its base to palmar member 20 by fixing pin 21, and has on its top a pair of knuckles 31*a* and 31*b* through which axis 33 rotatably passes, as shown in FIG. 4. Similarly, rotary member 32 has a pair of knuckles 32*a* and 32*b* formed at its base ends, and these knuckles 32*a* and 32*b* are fastened to axis 33 passing therethrough. When glove 10 is worn, these knuckles 31*a*, 31*b*, 32*a*, 32*b*, and axis 33 are placed at the joints at the root of the fingers (i.e., the second joint of the thumb and the third joints of the other four fingers). Thus, each of the digit members 40, in conjunction with rotary members 32 of joint portions 30, rotates in a plane perpendicular to palmar member 20 in response to the bending of the corresponding finger at the joint at the root of the finger.

Figure 5:
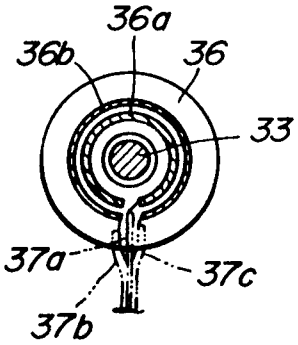
FIG. 5 is a sectional view taken on line V—V in FIG. 4.

Collar 34 is fastened at the center of axis 33. On collar 34, slider 35 made of an electrically conductive beam spring is provided, so that slider 35 makes contact with a circular printed-circuit board 36 attached to a side of knuckle 31*b* of fixed member 31. Printed-circuit board 36, as shown in FIG. 5, has two concentric C-shaped circular layers: conductive layer 36*a* and resistance layer 36*b* on which each leg 35*a* and 35*b* of slider 35 contacts, respectively. The slider 35, conductive layer 36*a*, and resistance layer 36*b*, constitute rotary detector RD.

Lead wire 37*a* is connected to the end of conductive layer 36*a*, and lead wires 37*b* and 37*c* are connected to each end of resistance layer 36*b*. These lead wires 37*a*, 37*b* and 37*c* are soldered on the reverse side of printed board 36, pass outside through a hole formed in knuckle 31*b* of fixed member 31, fixed to palmar member 20 by fastener 22, 22, . . . , and are thus drawn downward.

Each digit member 40 has metal rod 41 and tubular member 42: each rod 41 has a length corresponding to that of a finger on which the rod 41 is placed, and each tubular member 42 is made of synthetic resin. At each base of rods 41, there is provided a hook which is rotatably looped around pin 38 formed or fastened on rotary member 32. Each pin 38 has round head 38*a*formed or fastened on top thereof to stop the hook at the bottom of rod 41. When the musical-tone-control apparatus is worn, each pin 38 is placed slightly below the root of the finger, and allows digit member 40 to rotate in the plane of the palm in response to the lateral movement of the fingers.

The uppermost portion of each rod 41 is slidably inserted into the tubular member 42 from the bottom thereof, and stopper member 43 attached to the top end of rod 41 prevents rod 41 from being pulled out of tubular member 42. Outside the upper portion of each tubular member 41, finger-contact member 44 is formed or fastened. Finger-contact members 44 are made of a thin material and conform to the shapes of the finger tips, so that finger-contact members 44 fit to the finger tips when glove 10 is worn.

Next, a musical-tone-generating apparatus controlled by the musical-tone-control apparatus of the above configuration will be described. The musical-tone-generating apparatus, as shown in FIG. 7, is connected to rotary detector RD by lead wires 37*a* to 37*c*, and is worn on some part of the body of a performer. The musical-tone-generating apparatus includes musical-tone-control-signal-generating circuit 51, musical-tone-signal-generating circuit 52, and sound system 53. One end of lead wire 37*b* is connected to one end of resistance layer 36*b* constituting rotary detector RD, and the other end of lead wire 37*b* is connected to voltage V. On the other hand, one end of lead wire 37*c* is connected to the other end of resistance layer 36*b*, and the other end of lead wire 37*c* is grounded. Lead wire 37*a*, of which one end is connected to conductive layer 36*a* produces at the other end thereof, a voltage corresponding to a position of slider 35, i.e., a position specified by a rotation of digit member 40 in response to the bending of the finger.

The other end of lead wire 37*a* is connected to the input terminal of A/D (Analog-to-Digital) converter 51*a* in musical-tone-control-signal-generating circuit 51. The A/D converter 51*a* converts an analog input signal into a digital signal, and transmits the digital signal to musical-tone-signal-generating circuit 52 and a first input terminal of comparator 51*b* as a touch-response signal TR. To the second input terminal of comparator 51*b*, reference-level signal LVref is fed, which represents a predetermined reference level, so that comparator 51*b* produces key-on signal KON and supplies it to musical-tone-signal-generating circuit 52 when touch-response signal TR exceeds reference-level signal LVref.

Musical-tone-signal-generating circuit 52 produces musical tones each of which has a tone pitch assigned to each finger in response to key-on signal KON. At the same time, musical-tone-signal-generating circuit 52 controls musical-tone characteristics such as tone volumes and tone colors in response to touch-response signal TR, and the musical-tone signals thus produced are supplied to sound system 53. Sound system 53 includes amplifiers and speakers to produce musical tones corresponding to the musical-tone signals fed from musical-tone-signal-generating circuit 52.

The operation of the embodiment will now be described:

First, a performer (i.e., a person who controls the generation of musical tones) wears the musical-tone-generating apparatus on some portion of the body, for example, on the waist. The musical-tone-generating apparatus includes musical-tone-control-signal-generating circuit 51, musical-tone-signal-generating circuit 52 and sound system 53. In addition, the performer wears on one hand a glove including the musical-tone-control device. The performer can select a suitable glove size because several sizes of gloves are provided for. When the performer wears a suitable glove, the musical-tone-control apparatus including palmar member 20, joint portion 30, and digit member 40 fits to the performer's hand because palmar member 20 is shaped to fit the palm, and finger-contact members 44 are shaped to fit the finger tips. Thus, the musical-tone-control apparatus is snugly fit to the performer's hand so as to be hardly displaced. In such a situation, axis 33 and pin 38 of each joint portion 30 are placed at positions shown in FIG. 8: axis 33 is placed at position Pl which is located just under the third joint of each of the four fingers; and pin 38 is placed at position P2 which is slightly lower than the root of each finger. Thus, bending of a finger at the third joint and the movement of the fingers in the plane of the hand become easy. In the case of the thumb, the above description holds true by replacing the third joint in the above description with the second joint of the thumb.

The movement of the fingers, i.e., bending of the fingers and the movement thereof in the plane of the hand, does not break lead wires 37*a* to 37*c* when digit members 40 rotate about axes 33, because of the construction around lead wires 37*a* to 37*c*: first, each axis 33 around which digit member 40 bends is located lower than pin 38 around which the fingers move in the plane of the hand; second, lead wires 37*a* to 37*c* are connected to rotary detector RD that detects the bending of the finger in a manner that each end of the lead wires 37*a* to 37*c* is connected to printed-circuit board 36 which is fastened to knuckle 31*b* of fixed member 31, and lead wires 37*a* to 37*c* pass out through knuckle 31*b*; thus, the finger bending and the finger movement in the plane of the hand do not displace lead wires 37*a* to 37*c*.

In such a situation, when one of the four fingers except the thumb is bent at the third joint (in the case of the thumb, it is bent at the second joint), digit member 40 rotates about axis 33 of joint portion 30, so that digit member 40 bends forward as shown in FIG. 9. With the bend of the third joint, the first and the second joints of the finger are bent slightly (in the case of the thumb, the first joint is bent slightly when bending the second joint). Thus, the finger curves slightly inwardly, and this causes a small variation in the length from the root of the finger to the tip. With the variation of the length of the finger, tubular member 42 moves downward so that the tip of rod 41 enters into the deep of tubular member 42 so as to change the longitudinal length of digit member 40, thereby smoothing the bending of the finger.

As described above, when the finger is bent, rotary member 32 of joint portion 30 rotates forward, so that axis 33 which is fixed to knuckles 32*a* and 32*b* rotates in the bores of knuckles 31*a* and 31*b*. With the rotation of axis 33, slider 35 attached to collar 34 rotates on conductor layer 36*a* and resistor layer 36*b* of printed-circuit board 36, so as to produce an analog voltage corresponding to the bend of the finger from lead wire 37*a*. The analog voltage is fed to musical-tone-control-signal-generating circuit 51, and is converted into touch-response signal TR by means of A/D converter 51*a*. Touch-response signal TR is fed to comparator 51*b* in musical-tone-control-signal-generating circuit 51 so as to produce key-on signal KON. These touch-response signal TR and key-on signal KON are sent to musical-tone-signal-generating circuit 52. This circuit 52 generates a musical-tone signal in response to signals TR and KON: the musical-tone signal having a tone pitch specified by the bent finger, and having tone characteristics, such as tone color and tone volume, controlled in response to the degree of bending of the finger. The musical-tone signal is supplied to sound system 53 which produces musical tones corresponding to the musical-tone signal Thus, musical tones corresponding to the bend of the fingers are produced from sound system 53.

According to the musical-tone-control apparatus described above, the performer can enjoy a performance of the musical instrument without hindering the free movement of the body, because the musical tones are generated in response to the bend of the fingers of the performer wearing glove 10 on the hand. In addition, an audience of the performance can enjoy not only the music but also the visual performance of the performer.

Furthermore, the apparatus facilitates an accurate performance, because musical tones are controlled by the bending of digits around at the joints furthest apart from the tips of the digits, (i.e., the second joint of the thumb and the third joint of each of the four fingers), and so each finger is easily bent independently.

In addition, the apparatus facilitates the movement of the fingers and the hand because of the following reasons: first, the arrangement of knuckles 31*a*, 31*b*, 32*a*, 32*b* of joint portion 30 and axis 33 enables bending of the fingers; second, pin 38 of joint portion 30 and the lower end of rod 41 enable the movement of fingers in the plane of the hand.

Although a specific embodiment of a musical-tone-control apparatus constructed in accordance with the present invention has been disclosed, it is not intended that the invention be restricted to either the specific configurations or the uses disclosed herein. Modifications may be made in a manner obvious to those skilled in the art. For example:

(1) Although in the embodiment described above a set of musical-tone-control apparatus and glove 10 is worn on one hand, a set of musical-tone-control apparatus and glove 10 can be worn on each hand so that musical tones are controlled in response to the movement of fingers of both hands.

(2) Although the above embodiment controls musical tones in response to the movement of all the fingers of the hand, it is possible to control musical tones in response to the movement of fingers fewer than five.

(3) Although the musical-tone-generating apparatus in the above embodiment includes musical-tone-control-signal-generating circuit 51, musical-tone-signal-generating circuit 52, and sound system 53, and is worn on some portion of a performer's body, the musical-tone-generating apparatus need not be worn on the performer, and can instead be located near the performer. To accomplish such an arrangement, a glove provided with a wireless transmitter that sends the detection signals produced by rotary detectors RD is worn on the hand, while a musical-tone-generating apparatus having in addition to the above components of the embodiment a wireless receiver that receives the signal from the transmitter is located near the performer. Thus, the performer can play more freely.

(4) Although in the above embodiment, musical-tone components such as tone pitches, tone colors, and tone volumes are controlled in response to the outputs of rotary detectors RD, i.e., the movement of the fingers, other tone components such as an octave of tone pitches, sound effects, and the level of the sound effects, can be controlled in response to the movement of the fingers.

(5) Although in the above embodiment, rotary detectors RD provided at joint portions 30 detect rotatory displacement (bending) of digit members 40 in the form of analog signals, the rotary detectors RD can be replaced by switch-type detectors. Each switch-type detector is maintained in the off state until digit member 40 rotates through a predetermined angle, and then turns on when digit member 40 exceeds the predetermined angle. The musical-tone generation and sound effects are controlled in a manner so that they are present or absent in response to the output of the switch-type detector.

(6) Although in the above embodiment, only the bending of the fingers is detected to thereby control musical tones, the movement of the fingers in the plane of the hand can be detected so as to control musical tones accordingly. To achieve this, the rotation of each rod 41 around the pin 38 is detected b means of rotary detectors, and musical tones are controlled in response to the outputs of the rotary detectors as well.

Accordingly, it is intended that the invention be limited only by the scope of the appended claims.

What is claimed is:

1. A musical-tone-control apparatus comprising:

a palmar member worn on the palm of a performer;

one or more digit members, each of which is rotatably connected to the upper edge of said palmar member, an worn along the finger of th performer; and one or more measuring means for measuring the angle of flexion of corresponding digit members relative to said palmar member and producing a musical-tone-control signal based on the measurement, wherein each of said digit members is separated into two segments which are interconnected so as to contract or expand the digit member in the longitudinal direction of said digit member in response to the bending or straightening of the finger.

2. A musical-tone-control apparatus according to claim 1, wherein said digit members are five or less.

3. A musical-tone-control apparatus according to claim 2, further comprising a second palmar member, second digit members, and second detecting means incorporated into a second glove and wherein said gloves are worn on a performer's hands.

4. A musical-tone-control apparatus according to claim 1, wherein said digit members are five or less.

5. A musical-tone-control apparatus according to claim 1, further comprising musical-tone-generating means having musical-tone-control-signal-generating means for generating tone-control signals in response to the measurement of said measuring means, a musical-tone-signal-generating circuit for generating musical-tone signals in response to the tone-control signals, and a sound system for producing musical sound in response to the musical-tone signals.

6. A musical-tone-control apparatus according to claim 5, wherein said musical-tone-generating means is worn on a performer's body.

7. A musical-tone-control apparatus according to claim 5, wherein said measuring means is connected to a wireless transmitting means for transmitting the outputs of said detecting means, and said musical-tone-control apparatus is further provided with wireless receiving means for receiving the output of said wireless transmitting means, said musical-tone-generating means is placed near the performer.

8. A musical-tone-control apparatus according to claim 1, wherein the outputs of said measuring means are used to control tone pitches, tone colors and tone volumes of the generated tones.

9. A musical-tone-control apparatus according to claim 1, wherein the outputs of said measuring means are used to control the octave of the generated tones, and to produce sound effects and to control the magnitude of the effects.

10. A musical-tone-control apparatus according to claim 1, wherein each of said measuring means detects the movement of said digit members in a plane in which the digit members lie as well as the rotation of said digit members in a plane perpendicular to the palm.

11. A musical-tone-control apparatus comprising:

a palmar member worn on the palm of a performer;

one or more rotary members, each of which is rotatably connected to the upper edge of said palmar member, wherein said each rotary member is provided so as to rotate in a first plane substantially perpendicular to the palm of the hand;

one or more digit members each of which is rotatably connected to the upper portion of a corresponding one of said rotary members, and worn along the finger of the performer, wherein each said digit member is provided as to rotate in a second plane substantially perpendicular to said first plane; and one or more measuring means for measuring the angle of flexion of a corresponding one of said rotary members relative to said palmar member and producing a musical-tone-control signal varying in relation tot he angle.

12. A musical-tone-control apparatus according to claim 11, wherein each of said measuring means is incorporated into the connecting portion of said palmar member and each of said rotary members.

13. A musical-tone-control apparatus according to claim 1, wherein the outputs of said measuring means are used to control the octave of the generated tones.

14. A musical-tone-control apparatus according to claim 1, wherein the outputs of said measuring means are used to produce sound effects and to control the magnitude of the effects.

15. A musical-tone-control apparatus according to claim 11, wherein each of said rotary members is provided on the joint at the root of each finger.

16. A musical-tone-control apparatus according to claim 11, wherein said palmar member is curved so as to conform to the shape of the palm.

* * * * *